US005909164A

United States Patent [19]

Lee

[11] Patent Number: 5,909,164

[45] Date of Patent: Jun. 1, 1999

[54] SEPARABLE CIRCUIT BREAKER

[75] Inventor: Sang Don Lee, Cheongju, Rep. of Korea

[73] Assignee: LG Industrial Systems Co., Ltd., Seoul, Rep. of Korea

[21] Appl. No.: 09/002,683

[22] Filed: Jan. 5, 1998

[51] Int. Cl.[6] ..... H01H 9/02

[52] U.S. Cl. ..... 335/202; 335/132

[58] Field of Search ..... 335/18.6, 131–2, 335/202; 200/295–305; 361/42–49

[56] References Cited

U.S. PATENT DOCUMENTS

| | | | |
|---|---|---|---|
| 4,884,048 | 11/1989 | Castonguay et al. | 335/18 |
| 5,231,365 | 7/1993 | Kato | 335/132 |
| 5,241,289 | 8/1993 | Markowski et al. | 335/201 |
| 5,276,417 | 1/1994 | Blanchard et al. | 335/132 |
| 5,414,395 | 5/1995 | Garnto et al. | 335/202 |
| 5,477,201 | 12/1995 | Garnto et al. | 335/18 |

*Primary Examiner*—Lincoln Donovan
*Attorney, Agent, or Firm*—Oliff & Berridge, PLC

[57] ABSTRACT

A separable circuit breaker includes a separate trip apparatus portion, having a trip apparatus and a trip apparatus container, and a switching apparatus portion having a switching apparatus and a switching apparatus container. The switching apparatus and trip apparatus are connectable by connection terminals in a lower part of the respective containers. The trip apparatus portion also includes a trip apparatus cover connected to an upper portion of the trip portion container and an assistant cover rotatably connected to an upper portion of the trip apparatus cover. The assistant cover allows access to the trip apparatus. The trip appartus includes a bimetal element and an armature. The switching apparatus portion includes a crossbar and a handle. The crossbar is connected and engaged with the armature according to deformation of the bimetal element such that current flow through the circuit breaker can be opened by rotation of the crossbar when an overcurrent exists. The handle can close the circuit after it has been opened by the overcurrent condition.

4 Claims, 11 Drawing Sheets

SEPARABLE CIRCUIT BREAKER

BACKGROUND OF THE INVENTION

1. Field of the Invention

The present invention relates to a separable circuit breaker, and in particular to an improved separable circuit breaker which is capable of separately forming a trip apparatus casing and a switching apparatus casing, thus easily assembling the same.

2. Description of the Background Art

As shown in FIG. 1, the conventional circuit breaker includes a casing 1 formed of an insulation resin material and a cover 2. The inner structure formed inside the casing 1 and the cover 2 is composed of a trip apparatus and a switching apparatus.

The trip apparatus includes a bimetal 3, and a heater 5 installed below the bimetal 3 and a heater 5 having a fixing core 4. The heater 5 is connected with a load terminal 6.

In addition, beside the bimetal 3, an armature 7, which is rotatable, is fixed to the wall of the casing 1 and has a protrusion (not shown).

At this time, the bimetal 3 and the armature 7 are formed in a multiple number, respectively. Here, three pairs are adapted in a three phase electrode structure.

A protrusion (not shown) is formed above the bimetal 3 and the armature 7, and the above-described protrusion is crossingly spaced-apart from a trip crossbar by a predetermined distance.

At this time, the plate-shaped protrusions 8*a* of the bimetal 3 and the armature 7, which protrusions correspond with each electrode, are formed in one side of the trip crossbar 8, and a protrusion (not shown) is formed in another side of the trip crossbar 8 for pushing a latch holder 9.

The switching apparatus includes a mechanism unit and a fixed contact 10 and a movable contact 11 which are operable in accordance with the operation of the trip apparatus.

The fixed contact 10 is attached on an upper surface of a fixing contactor 13 connected with a power terminal 12.

A holder 15 one side of which is engaged with a movable contactor 14 is connected with an elongated shaft 16.

At this time, the movable contactor 14 is upwardly and downwardly movable with respect to the fixing shaft 20 connected with a side plate 17, and a grid 18 is formed outside a movable space of the movable contactor 14.

The mechanism unit of the switching apparatus is formed to configure the bimetals 3 and the armatures 7 which are installed in the center electrode. In more detail, the mechanism unit is composed of a latch 19 which is upwardly and downwardly movable with respect to a latch pin 17*a* fixed to the side plate 17, and a latch holder 9 on end of which is engaged with the latch 19 and the other side of which is connected with the trip crossbar 8.

A toggle link 21 is installed in an upper side of the holder 15 and connected by the holder pin 15*a*, and an upper link 22 is installed, one side of which is connected with the toggle link 21 by a link pin 23 and the other side of which is connected with the latch 19 by the upper link pin 22*a*, so that the upper link 22 is movable in a predetermined direction.

At this time, the link pin 23 is engaged with a spring 25 connected with the lever 24, and a manually operable handle 26 is installed in the lever 24.

The thusly constituted conventional circuit breaker is an apparatus for preventing an over current in a low voltage housing system and has a switching function with respect to a load current and failed current and a feature that it is reused after a predetermined breaking operation.

In the normal operational state of the conventional circuit breaker, the current flowing sequences are as follows: the power terminal 12-->the fixed contactor 13 -->the movable contact 11-->the movable contactor 14-->the heater 5-->the load terminal 6.

The operation of the conventional circuit breaker will now be explained when the over current or short circuit current which exceeds a rated current flows in the circuit breaker.

If an over current which exceeds a rated current flows in the circuit breaker, the bimetal 3 becomes curved, and the trip operation in which the trip crossbar 8 is pushed is slowly performed. If the short circuit current flows in the system, a strong magnetic field is formed by the fixing core 4, so that the lower portion of the armature 7 is quickly and downwardly moved due to the magnetic field force, and at the same time, the protrusion (not shown) formed in an upper portion of the armature 7 pushes the trip crossbar 8. The above-described operation is called the quick trip operation. Therefore, the trip operation is quickly performed.

When the trip crossbar 8 is pushed during the slow trip operation of the bimetal 3 and the quick trip operation of the armature 7, the trip crossbar 8 is rotated, and the latch holder 9 is pushed by the rotation of the trip crossbar 8, so that the latch 19 engaged with the latch holder 9 is released therefrom, and thus the upper link 22 and the toggle link 21 are curved by the elastic force of the spring 25.

As the upper link 22 and the toggle link 21 are curved, the holder 15 connected with the toggle link 21 and the movable contactor 14 connected with the holder 15 are quickly and upwardly moved, so that the fixed contact 10 and the movable contact 11 are opened.

At this time, since the holder 15 and the movable contactor 14 are coaxially connected, and the fixed contact 10 and the movable contact 11 are opened, other electrodes are opened by the shaft 16.

At this time, at the time when the fixed and movable contacts 10 and 11 are opened, a predetermined arc occurs in the fixed and movable contacts 10 and 11.

The above-described arc is absorbed by the grid 18, and the blocking operation is finished.

However, in the above-described conventional beaker, when changing the capacity or rated current, the entire circuit breaker should be changed, thus causing much inconvenience.

SUMMARY OF THE INVENTION

Accordingly, it is an object of the present invention to provide a separable circuit breaker which overcomes the aforementioned problems encountered in the background art.

It is another object of the present invention to provide a separable circuit breaker which is capable of separately forming a casing of a trip apparatus and a casing of a switching apparatus, thus more easily assembling the same.

It is another object of the present invention to provide a separable circuit breaker by which it is convenient to easily change the capacity or the rated current, thus enhancing the workability of the system.

To achieve the above objects, there is provided a separable circuit breaker which includes a trip apparatus casing including a trip apparatus, and a switching apparatus casing engaged with the trip apparatus casing and including the switching apparatus.

Additional advantages, objects and features of the invention will become more apparent from the description which follows.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

The separable circuit breaker according to the present invention will now be explained with reference to the accompanying drawings.

Figure 1:
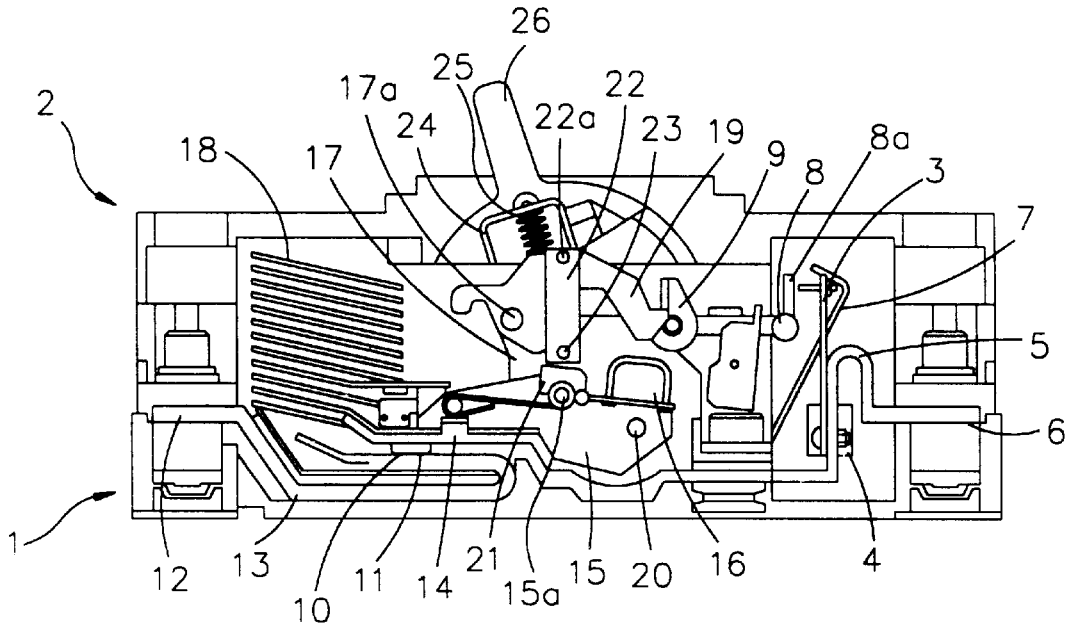
FIG. 1 CONVENTIONAL ART
FIG. 1 is a cross-sectional view illustrating a conventional circuit breaker.
Figure 2:
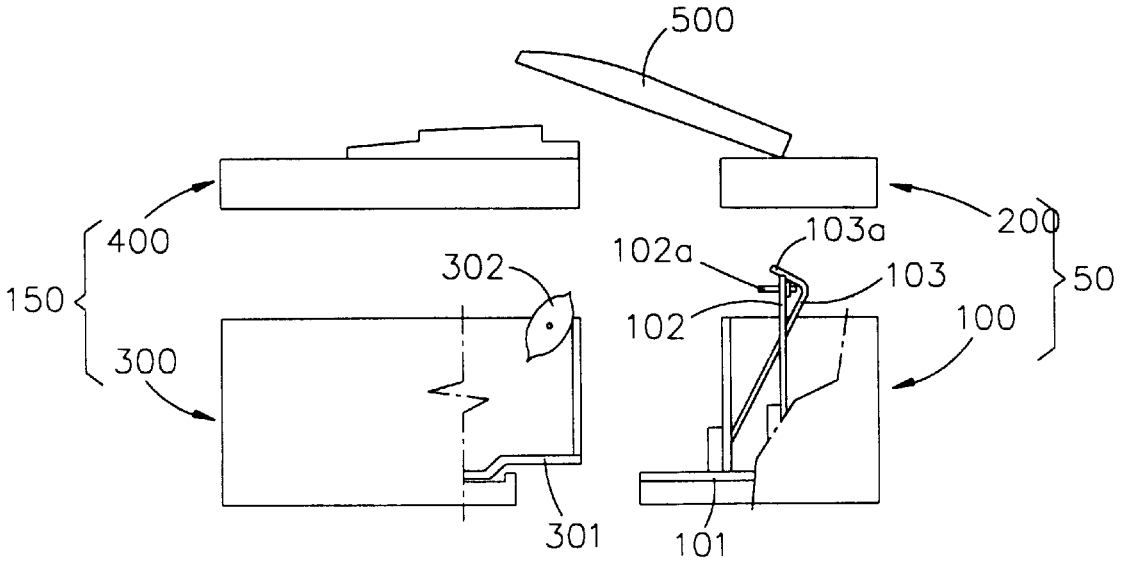
FIG. 2 is a schematic view illustrating a separable circuit breaker according to a first embodiment of the present invention.

First, the circuit breaker includes a trip apparatus for detecting an over current and automatically blocking the circuit, a switching apparatus for manually switching the circuit, a handle for switching the switching apparatus, and a trip button for manually performing the trip apparatus. As shown in FIG. 2, the separable circuit breaker according to a first embodiment of the present invention includes a trip apparatus casing 50 and a switching apparatus casing 150. The trip apparatus casing 50 includes a trip apparatus container 100, the upper side of which is opened, including the trip apparatus therein, and a trip apparatus cover 200 for covering the trip apparatus container. In addition, the switching apparatus casing 150 engaged with the trip apparatus casing 50 includes a switching apparatus container 300 having the switching apparatus therein and an opened upper side, and a switching apparatus cover 400 covering the switching apparatus container 300.

In addition, an assistant cover 500, which is rotatable in the up and down directions, is engaged to the upper portion of the trip apparatus cover 200.

The trip apparatus container 100 includes a bimetal 102, an armature 103, and a trip apparatus (not shown). There is provided a trip portion connection terminal 101 connected with a heater (not shown) in the contact surface with the switching apparatus container 300.

The switching apparatus container 300 includes a trip crossbar 302, and a switching apparatus (not shown) which is operable by the trip crossbar 302. In addition, there is provided a switching portion connection terminal 301 connected with the movable contactor (not shown) in the contact surface with the trip apparatus container 100.

A current flowing path is formed by connecting the trip apparatus casing 50 in which the trip apparatus cover 200 and the trip apparatus container 100 are engaged and the switching apparatus casing 150 in which the switching apparatus cover 400 and the switching apparatus container 300 are engaged, so that the current continuously flows through the trip portion connection terminal 101 and the switching portion connection terminal 301.

In addition, the bimetal 102 and the armature 103 include protrusions 102*a* and 103*a*, respectively, and are spaced-apart from the trip crossbar 302 by a predetermined distance.

When an over current occurs in the circuit breaker having the trip apparatus casing 50 and the switching apparatus casing 150, the bimetal 102 or the armature 103 pushes the trip crossbar 302, thus operating the switching apparatus. During the operation of the switching apparatus, the contacts are opened and the power is blocked in the same manner as in the conventional art.

The trip apparatus cover 200 and the trip apparatus container 100 of the trip apparatus casing 50 and the switching apparatus cover 400 and the switching apparatus container 300 of the separable circuit breaker according to the present invention will be explained in more detail.

Figure 3:
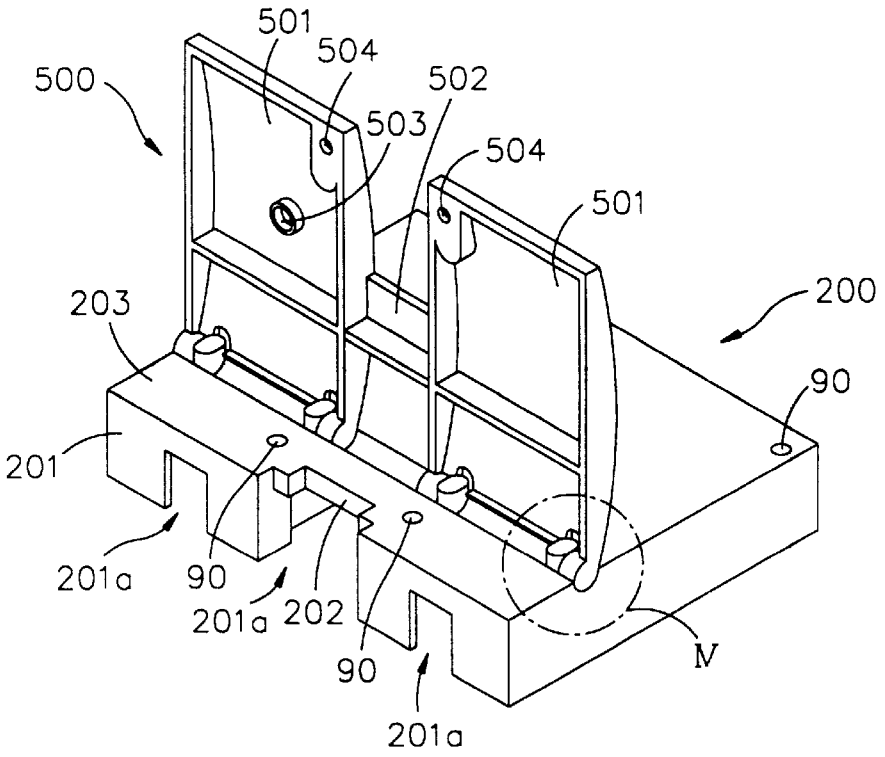
FIG. 3 is a perspective view illustrating a trip apparatus cover for a separable circuit breaker according to a first embodiment of the present invention.

First, the trip apparatus cover 200 of the separable circuit breaker will be explained with reference to FIG. 3.

There is provided a front wall having a plurality of openings 201*a* so that the bimetal 102 and the armature 103 become operable with the trip crossbar 302 of the switching apparatus container 300. A horizonal trip portion opening 202 is formed in the upper portion of the opening 201*a* formed in the center portion among the openings 201*a*.

In addition, the assistant cover 500 engaged to the upper portion of the trip apparatus cover 200 includes auxiliary apparatus covers 501 formed in both sides thereof, and a cover plate 502 is formed in the lower center portion between the auxiliary apparatus covers 501.

Screw engaging holes 504 are formed in each end portion of the auxiliary apparatus cover 501, and a trip button hole 503 into which a trip button (not shown) is inserted is formed in the auxiliary apparatus cover 501 so that the trip operation of the trip apparatus is performed.

In the drawings, reference numeral 90 denotes a screw engaging hole.

Figure 4:
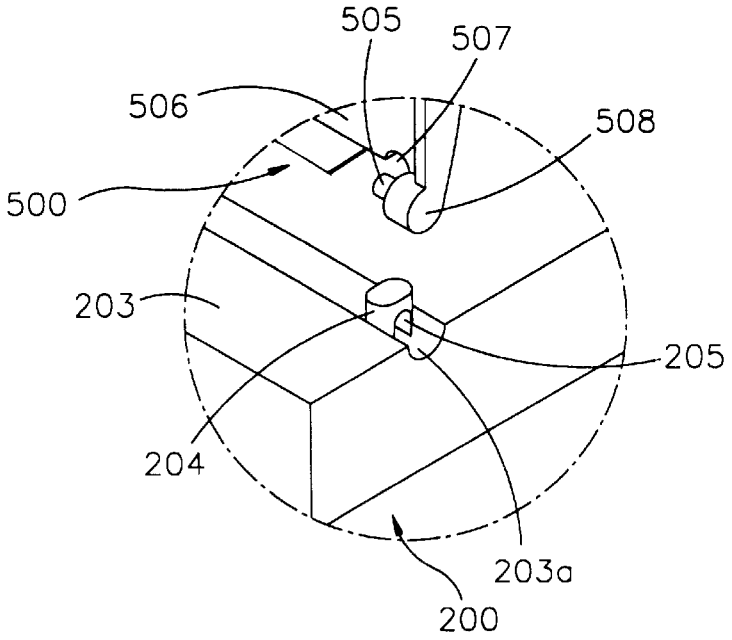
FIG. 4 is a perspective view illustrating an engaged structure of the portion IV of FIG. 3.

The engaging structure between the trip apparatus cover 200 and the assistant cover 500 engaged to the upper portion of the trip apparatus cover 200 will now be explained with reference to FIG. 4.

The elongated horizontal groove 203*a* having a semicircular cross section is formed in the trip apparatus cover 200 and across the upper surface 203 of the trip apparatus cover 200. An arch-shaped hinge hole 205 is formed to pass through the hinge engaging portion 204.

A semicircular engaging end portion 508 is formed in the engaging portion of the assistant cover 500, and an engaging protrusion 505 is formed in a side portion of the engaging end portion 508, and an arch-shaped cut-off portion 507 is formed in the rear-side cover surface 506 of the engaging protrusion 505.

The engaging of the trip apparatus cover 200 and the assistant cover 500 is performed in such a manner that the assistant cover 500 is made horizontal so that the cover surface 506 of the assistant cover 500 does not contact with the hinge engaging portion 204 of the trip apparatus cover 200, and then the engaging protrusion 505 of the assistant cover 500 is inserted into the hinge hole 207 of the trip apparatus cover 200 in the horizontal direction.

At this time, the cut-off portion 507 is formed in the cover surface 506 of the assistant cover 500. Therefore, when switching the assistant cover 500, the hinge engaging portion 206 of the trip apparatus cover 200 does not contact with the cover surface of the assistant cover 500.

Since the contact surface between the engaging end portion 508 of the assistant cover 500 and the horizontal groove 203*a* of the trip apparatus cover 200 is formed, the assistant cover 500 is easily rotatable with respect to the axis of the hinge engaging portion 204.

Figure 6:
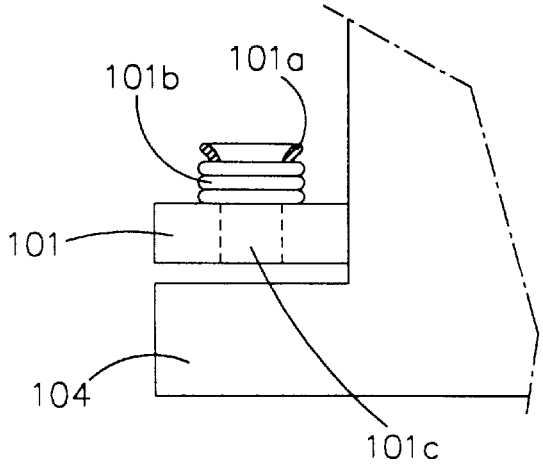
FIG. 6 is a partial perspective view illustrating a connection terminal of a trip portion for a trip apparatus container according to the present invention.

When engaging the assistant cover 500 engaged with the trip apparatus cover 200 engaged to the switching apparatus cover 400, the auxiliary apparatus cover 501 formed in both sides of the assistant cover 500 protects the auxiliary apparatus portion 404 of the switching apparatus cover 400 shown in FIG. 6.

The trip apparatus container 100 engaged to the lower portion of the trip apparatus cover 200 will now be explained with reference to FIGS. 5 and 6.

Figure 5:
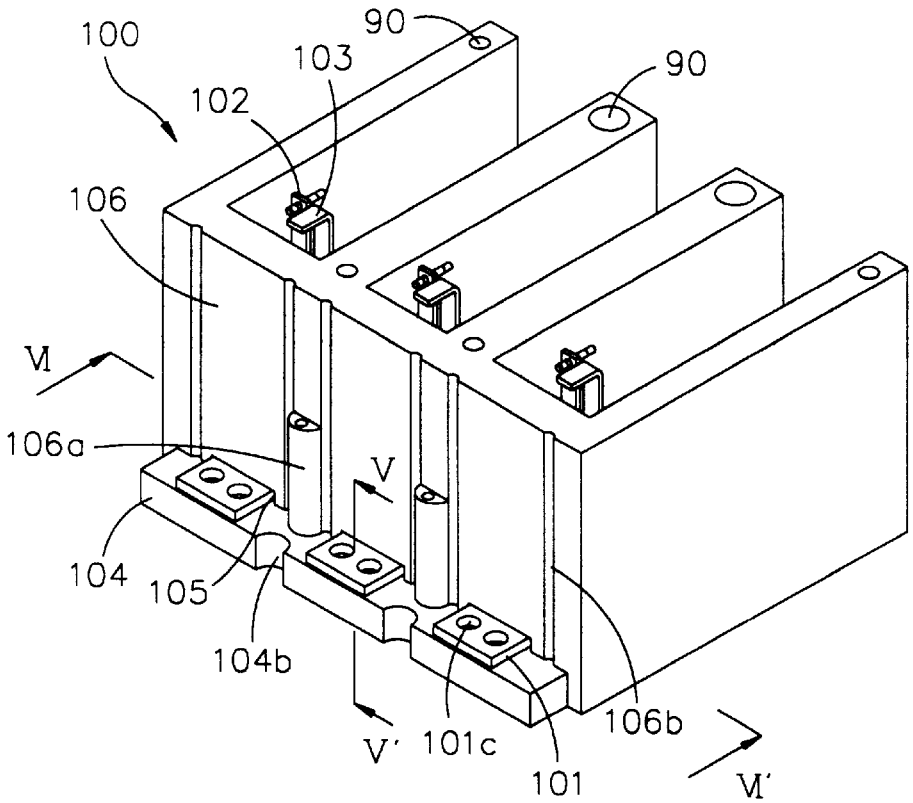
FIG. 5 is a perspective view illustrating a trip apparatus casing for a separable circuit breaker according to a first embodiment of the present invention.

In FIG. 5, the trip apparatus installed in the interior of the main body excluding the bimetal 102 and the armature 103 is not shown.

The trip apparatus container 100 includes a support shoulder 104 having a plurality of second guide grooves 104*b* vertically formed in a front lower portion, a plurality of vertical first guide grooves 106*b*, a front wall 106 formed to be opposite the switching apparatus container 300, a pair of insertion holes 101*c* supported by the support shoulder 104, and a trip portion connection terminal 101 exposed through a plurality of through holes 105 formed in the lower portion of the front wall.

There is provided an engaging portion 101*a* the lower portion of which is inserted into the insertion hole 101*c* of the trip portion connection terminal 101 and the upper portion of which is exposed to the upper portion of the trip portion connection terminal 101. The upper outer surface of the engaging portion 101*a* is covered by the spring 101*b*.

In addition, a semicircular column-shaped engaging guide 106*a* is formed on the front wall 106 and between the plurality of the through holes 105.

In the drawings, reference numeral 90 denotes a screw engaging hole.

Figure 7:
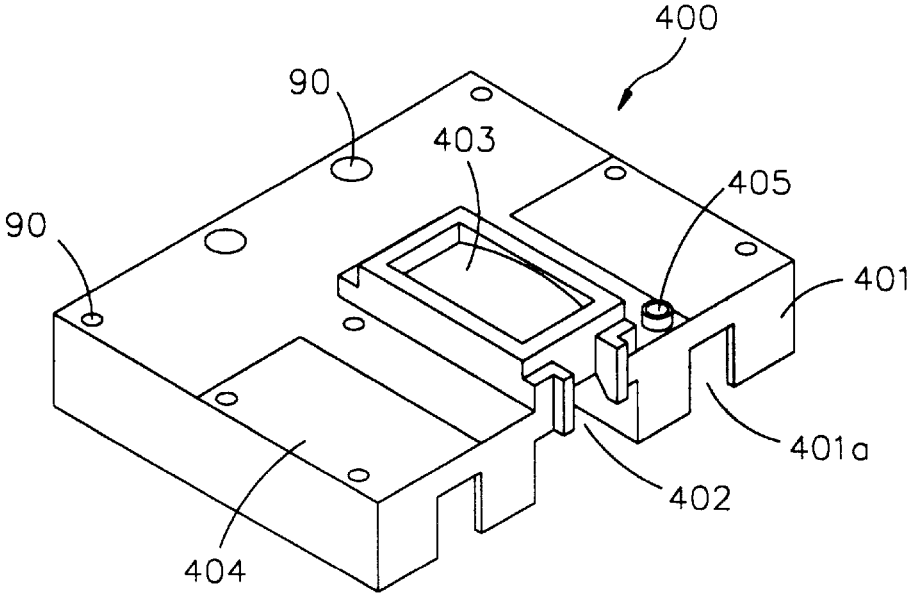
FIG. 7 is a perspective view illustrating a switching apparatus cover for a separable circuit breaker according to a first embodiment of the present invention.

FIG. 7 illustrates the switching apparatus cover 400. An opening portion 401*a* is formed in the front surface of each electrode, and a switching portion opening 402 is formed in an upper portion of the opening portion 401*a*.

In addition, a handle insertion portion 403 is formed in a rear side upper center portion of the switching portion opening 402, and an auxiliary apparatus portion 404 in which the auxiliary apparatus is provided is formed in both sides of the handle insertion portion 403, and a trip button hole 405 is formed in one side of the auxiliary apparatus portion 404.

At this time, the trip button hole 405 is formed so that the trip button (not shown) is exposed to the outside for a manual trip operation together with the trip button hole 503 of the assistant cover 500.

In the drawings, reference numeral 90 denotes a screw engaging hole.

In addition, the switching apparatus container engaged to the lower portion of the switching apparatus cover 400 will now be explained with reference to FIGS. 8 and 9.

Figure 8:
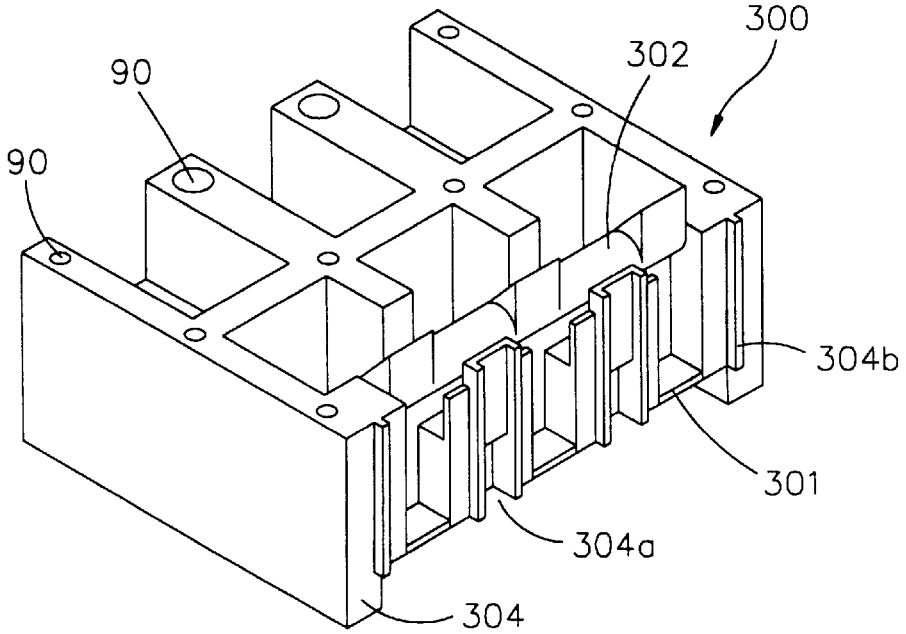
FIG. 8 is a perspective view illustrating a switching apparatus casing for a separable circuit breaker according to a first embodiment of the present invention.
Figure 9:
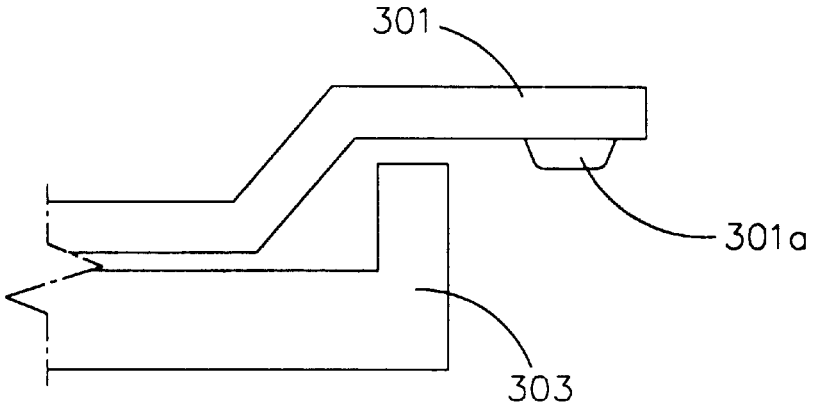
FIG. 9 is a perspective view illustrating a connection terminal of a switching portion of a switching apparatus container according to the present invention.
Figure 10:
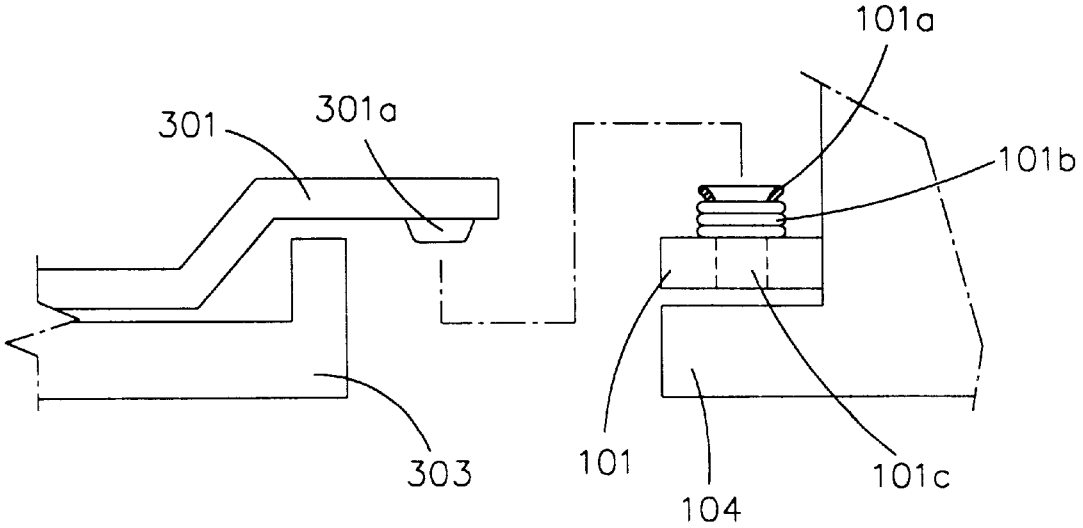
FIG. 10 is a cross-sectional view taken along the line V—V' when engaging the trip apparatus casing of FIG. 5 and the switching apparatus casing of FIG. 8.
Figure 11:
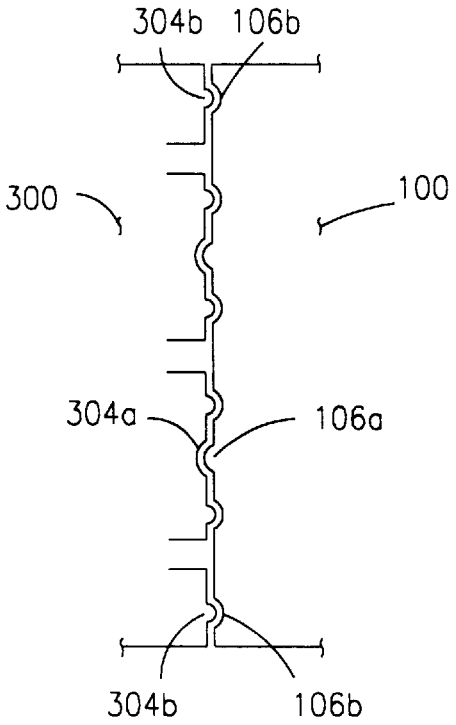
FIG. 11 is a cross-sectional view taken along the line VI—VI' when engaging the trip apparatus casing of FIG. 5 and the switching apparatus casing of FIG. 7.

In FIG. 8, the switching apparatus installed in the interior of the main body excluding the trip crossbar 302 is omitted.

Each electrode of the switching apparatus container 300 is opened, so that the switching portion connection terminal 301 is exposed, and a step 303 which is engaged with the support shoulder 104 of the trip apparatus container 100 is formed in a lower portion of the switching portion connection terminal 301.

In addition, a pair of engaging protrusions 301*a* are formed in the lower surface of the switching portion connection terminal 301.

An engaging guide groove 304*a* is formed between electrodes, and a plurality of assistant guides 304*b* are formed in the front surface of the step 303 and the front wall 304 of the switching apparatus container 300.

In the drawings, reference 90 denotes a screw engaging hole.

The trip apparatus casing 50 composed of the trip apparatus cover 200 and the trip apparatus container 100 and the switching apparatus casing 150 composed of the switching apparatus cover 400 and the switching apparatus container 300 are separately engaged.

When assembling the trip apparatus casing 50 and the switching apparatus casing 150, the same are engaged using the screws and the screw engaging holes 90.

In the thusly constituted separable circuit breaker, the engaging process between the trip apparatus casing 50 and the switching casing 150 will be explained with reference to FIGS. 2 and 5 and FIGS. 8 and 10.

First, the switching apparatus casing 150 composed of the switching apparatus container 300 and the switching apparatus cover 400 are assembled from the upper portion of the trip apparatus casing 50 composed of the trip apparatus container 100 and the trip apparatus cover 200 using the guides 106*a* and 304*b* and the guide grooves 106*b* and 304*a*.

The guides 106*a* and 304*b* are assembled along the guide grooves 106*b* and 304*a*, and the engaging protrusion 301*a* formed in the lower surface of the switching portion connection terminal 301 is inserted into the engaging portion 101*a* surrounded by the larger spring 101*b* having a large elastic force in the upper portion of the trip portion connection terminal 101, and the engaging protrusion 301*a* is pressed by the elastic forces of the spring 101*b* and the engaging portion 101*a*, so that a predetermined friction force is generated between the outer surface of the engaging protrusion 301*a* and the inner surface of the engaging port 101*a*.

The engaging state of the trip apparatus casing 50, the engaging guide 106*a* and engaging guide grove 304*a* of the switching apparatus casing 150, and the assistant guide 304*b* and the guide groove 106*b* enables an accurate and easier assembling of the system.

In addition, the engaging guide 106*a* is formed between the trip portion connection terminals (not shown) and has a function for enabling an insulation between the electrodes.

In the trip apparatus casing 50 and the switching apparatus casing 150, the assistant cover 500 engaged to the upper portion of the trip apparatus cover 200 of the trip apparatus casing 50 covers the switching apparatus cover 400 of the switching apparatus casing 150. Thereafter, the trip apparatus casing 50 and the switching apparatus casing 150 are assembled using the screw engaging holes 504 formed in the auxiliary apparatus cover 501 of the assistant cover 500.

Figure 12:
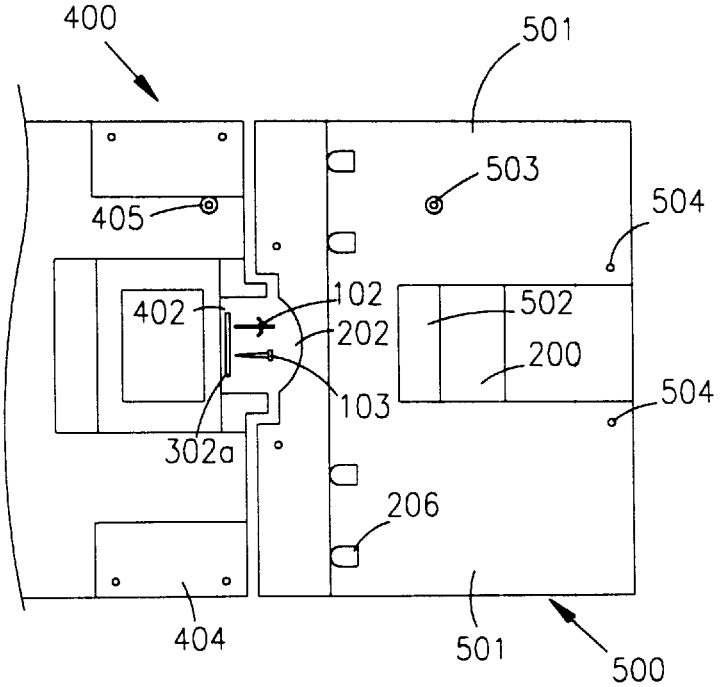
FIG. 12 is a plan view illustrating an exposed state when opening an assistant cover for a separable circuit breaker according to a first embodiment of the present invention.

In addition, as shown in FIG. 12, in the separable circuit breaker, when the assistant cover 500 is opened, there are formed openings 202 and 402 which communicate with the interior of the main body of the separable circuit breaker by the trip portion opening 202 of the trip apparatus cover 200 and the switching portion opening 402 of the switching apparatus cover 400.

At this time, the bimetal 102, the armature 103, the trip crossbar 302 and the protrusion 302*a* are exposed through the openings 202 and 402.

Figure 13:
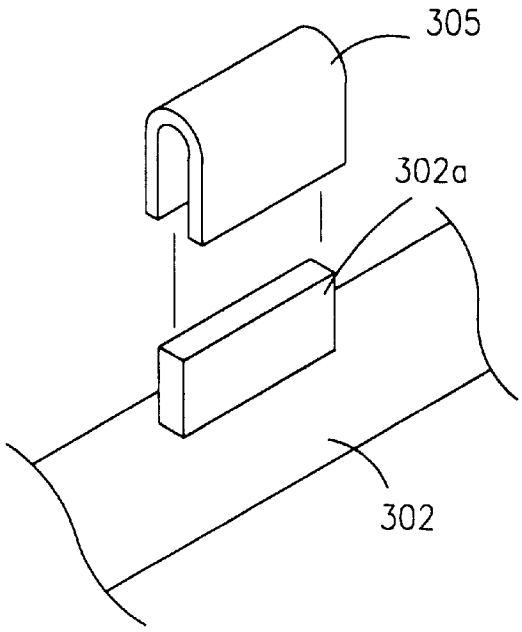
FIG. 13 is a perspective view illustrating an engaged structure of a trip crossbar and a cap.

The protrusion 302*a* of the thusly exposed trip crossbar 302, as shown in FIG. 13, is covered by the cap 305, so that the rated current during the slow tripping operation is controlled.

Figure 14A:
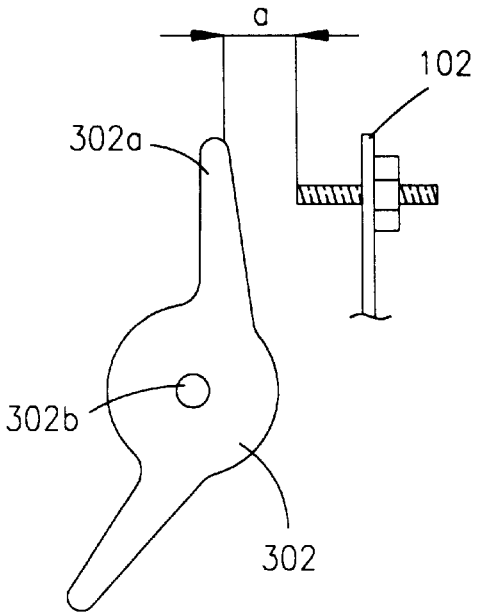
FIG. 14A is a partial perspective view illustrating a gap with a bimetal when a cap is not engaged with a trip crossbar.
Figure 14B:
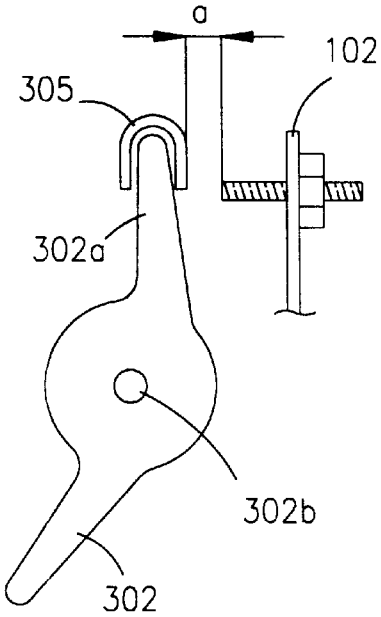
FIG. 14B is a perspective view illustrating a gap with a bimetal when a cap is engaged with a trip crossbar.

The controlling operation of the above-described rated current will now be explained with reference to FIGS. 14A and 14B. The trip crossbar 302 performs a trip operation in which the trip crossbar 302 is rotated with respect to the shaft 302*b* due to the curving of the bimetal 102. At this time, the rated current is changed in accordance with the curved portion of the bimetal 102, namely, the gap "a" between the bimetal 102 and the protrusion 302*a* of the trip crossbar 302.

Therefore, the cap 305 covers the protrusion 302*a* of the trip crossbar 302, and the gap "a" is adjusted by the thickness of the cap 305, so that it is possible to control the rated current during the slow trip operation.

The separable circuit breaker according to a first embodiment of the present invention is operated identically to the conventional circuit breaker, so that the description thereof will be omitted.

The separable circuit breaker according to a second embodiment of the present invention will now be explained.

First, in the second embodiment of the present invention, a thermal bar is further added.

Figure 15:
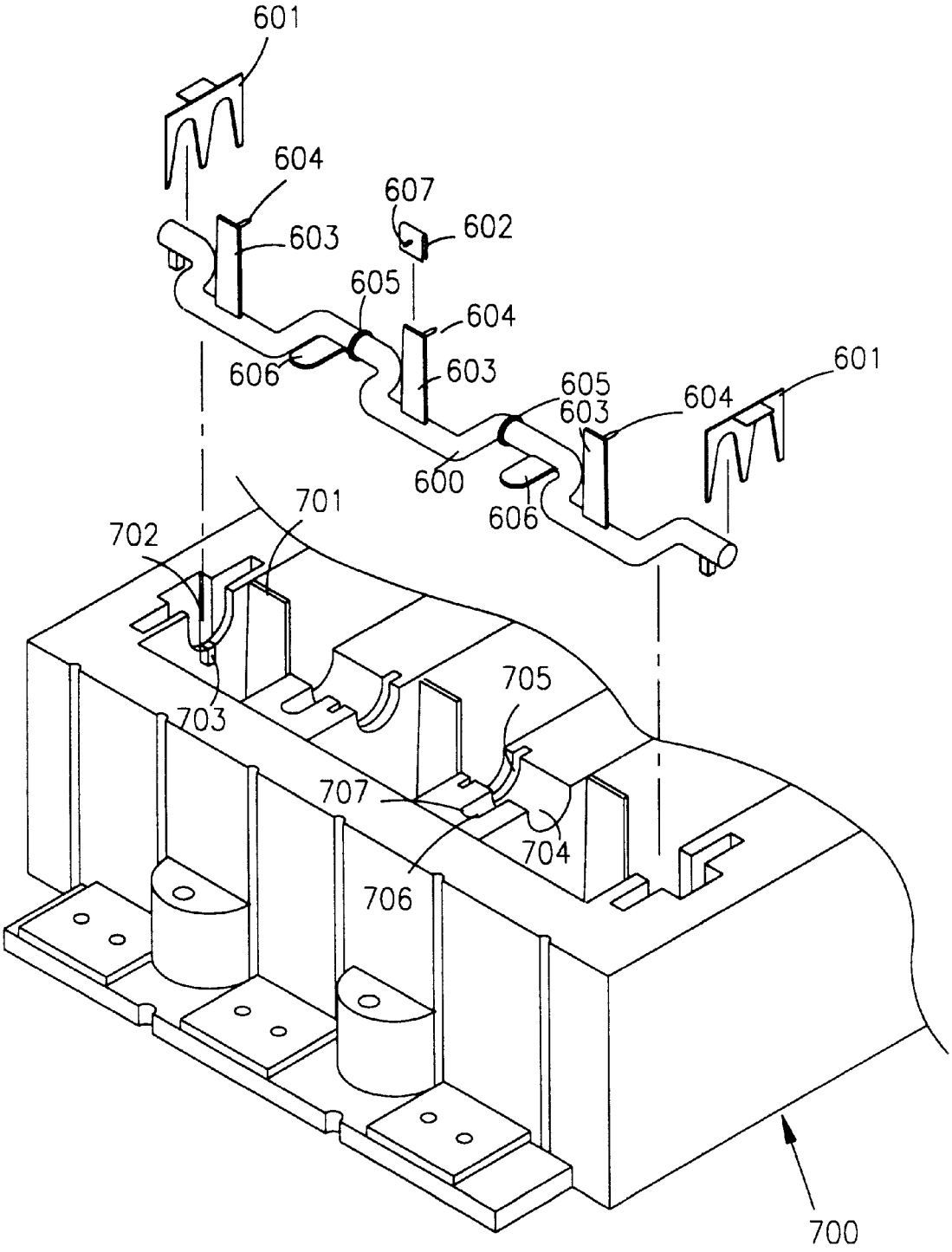
FIG. 15 is a perspective view illustrating the construction of a container of a trip apparatus for a separable circuit breaker according to a second embodiment of the present invention.

FIG. 15 illustrates the slow trip apparatus.

As shown therein, the separable circuit breaker according to the second embodiment of the present invention includes an engaging structure formed on the upper portion of the trip apparatus container 700 in which the bimetal 701 is installed, and a thermal bar engaged with the engaging structure.

An engaging groove 702 is formed in both ends of the engaging structure, and a clip groove 703 into which a clip 601 is inserted is formed in one side of the engaging groove 702.

A horizontal groove 704 in which the thermal bar 600 is disposed is formed in the upper surface of each wall which divides the electrodes, and a rib groove 705 is formed in the horizontal groove 704, and a spring groove 707 into which a spring 706 is inserted is formed in one side of the horizontal groove 704.

In addition, The thermal bar 600 includes a contact bar 603 having a protrusion 604 so that the trip operation effects of the bimetal 701 are transferred thereto, and a rib 605 is formed along the outer circumferential surface of the thermal bar 600, and a protrusion-shaped spring support plate 606 is formed in one side of the rib 605.

At both ends of the thermal bar 600, the clip 601 is inserted into the clip groove 703 formed at both sides of the trip apparatus container 700 so that the thermal bar 600 is forwardly and backwardly rotatable.

A thermal cap 602 covers the upper portion of the contact bar 603 of the central electrode of the thermal bar 600.

Figure 16:
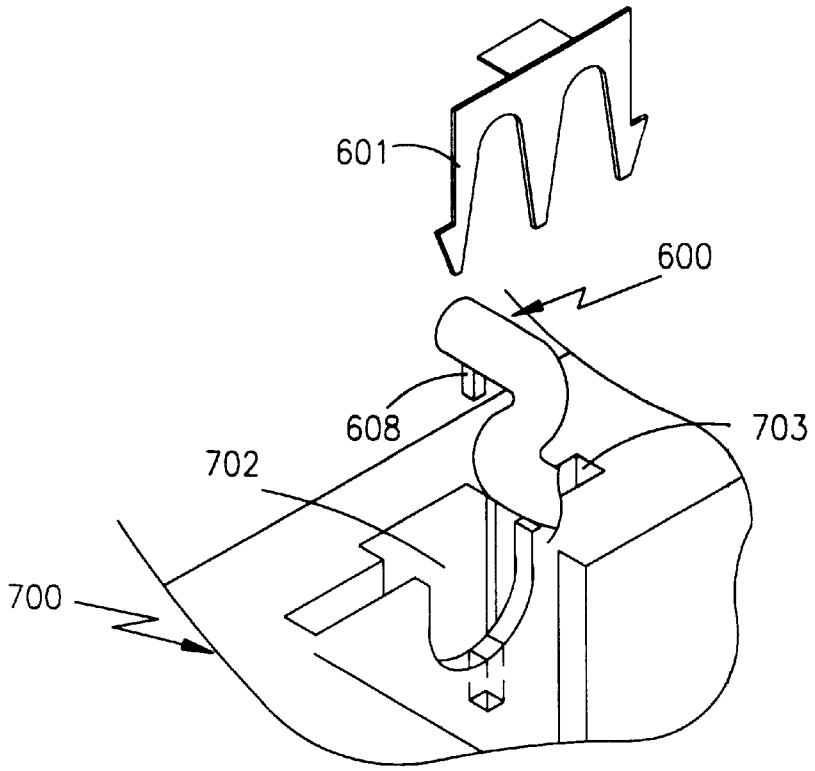
FIG. 16 is a detailed view illustrating an engaged state between a trip apparatus casing and a thermal bar.

The structure that the thermal bar 600 is engaged with the trip apparatus container 700 will now be explained with reference to FIG. 16.

A stopper 608 is formed in a lower surface of the thermal bar 600, and an end portion in which the stopper 608 is formed is inserted into the engaging groove 702 of the trip apparatus container 700, and the clip 601 is inserted into the clip groove 703 formed in one side of the engaging groove 702.

Figure 17A:
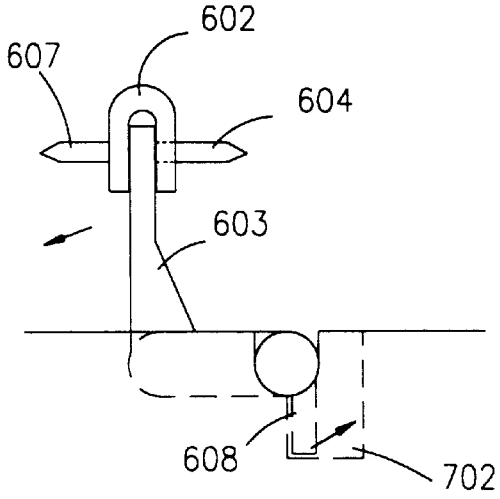
FIG. 17A is a view illustrating a stopper when a thermal bar is stopped.
Figure 17B:
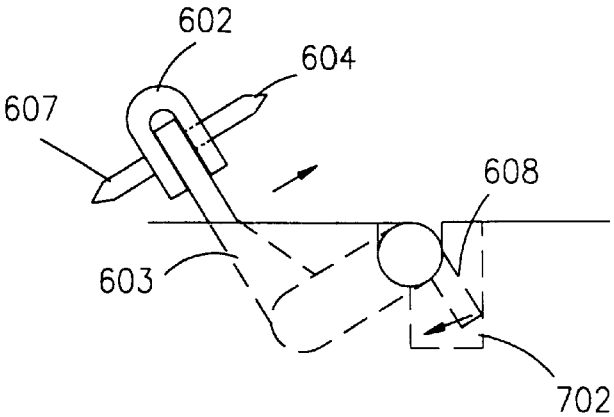
FIG. 17B is a view illustrating a stopper when a thermal bar is rotated.

At this time, as the thermal bar 600 is rotated, the stopper 608, as shown in FIGS. 17A and 17B, is engaged with the wall of the engaging groove 702 of the trip apparatus container 700, so that the rotation range of the thermal bar 600 is limited.

Figure 18:
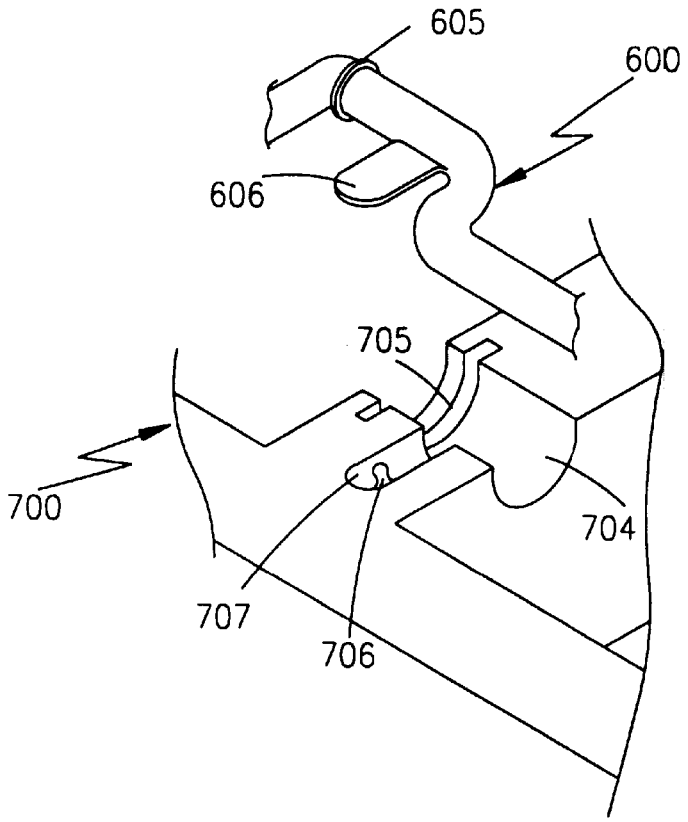
FIG. 18 is a detailed view illustrating an engaged state between a trip apparatus casing and a thermal bar.

The structure that the rib 605 formed in the thermal bar 600 and the spring support plate 606 are engaged with the trip apparatus container 700 will be explained. As shown in FIG. 18, the rib 605 is inserted into the rib groove 705 formed in the horizontal engaging groove 702 of the trip apparatus container 700, and the spring support plate 606 is inserted into the spring groove 706, into which the spring 706 is inserted, formed in one side of the rib groove 705.

In the separable circuit breaker having the trip apparatus container 700 in which the thermal bar 600 is installed, the trip apparatus and the switching apparatus except the trip apparatus container 700 is the same as the first embodiment of the present invention. Therefore, the description thereon will be omitted.

The operation of the separable circuit breaker according to a second embodiment of the present invention will now be explained.

When an over current occurs in the separable circuit breaker, the bimetal 701 is curved, and the bimetal 701 pushes the protrusion 604 formed in the thermal bar 600, so that the thermal is forwardly rotated thereby.

At this time, the trip protrusion 607 of the thermal cap 602 covering the central electrode of the thermal bar 600 pushes the trip crossbar (not shown) installed in the switching apparatus container (not shown), so that a trip operation is performed. The power blocking process is the same as the first embodiment of the present invention. Therefore, the description thereof will be omitted.

When the thermal bar 600 is rotated at a predetermined angle, the stopper 608 formed in an end lower surface of the thermal bar 600 is engaged by the wall of the engaging groove 702 of the trip apparatus container 700, so that the rotation thereof is stopped thereby. Therefore, it is possible to prevent the over rotation of the thermal bar 600.

When the thermal bar 600 is rotated, since the spring support plate 606 of the thermal bar 600 pushes the spring 706 inserted into the horizontal groove 704 of the trip apparatus container 700, so that the thermal bar 600 receives the repulsion force by the spring 706.

As the power is blocked, and the bimetal 701 is cooled, there is not any pushing force which is applied to press the thermal bar 600. Therefore, the thermal bar 600 is returned to the original position due to the repulsion force of the spring 706 inserted into the horizontal groove 704.

The thermal bar 600 which is returned to its original position is spaced-apart from the bimetal 701 as the stopper 608 formed in the end portion of the thermal bar 600 contacts with another wall surface of the engaging groove 702 of the trip apparatus container 700, thus preventing the rotation of the thermal bar 600.

The thermal bar 600 maintains its balance by the repulsion force of the spring 706 which is received by the spring support plate 606 and the resistance force of the wall of the engaging groove 702.

The rib 605 formed in one side of the spring support plate 606 of the thermal bar 600 is inserted into the rib groove 705 formed in the horizontal groove 704 of the trip apparatus container 700, so that a smooth rotation of the thermal bar 600 is enabled.

Figure 19:
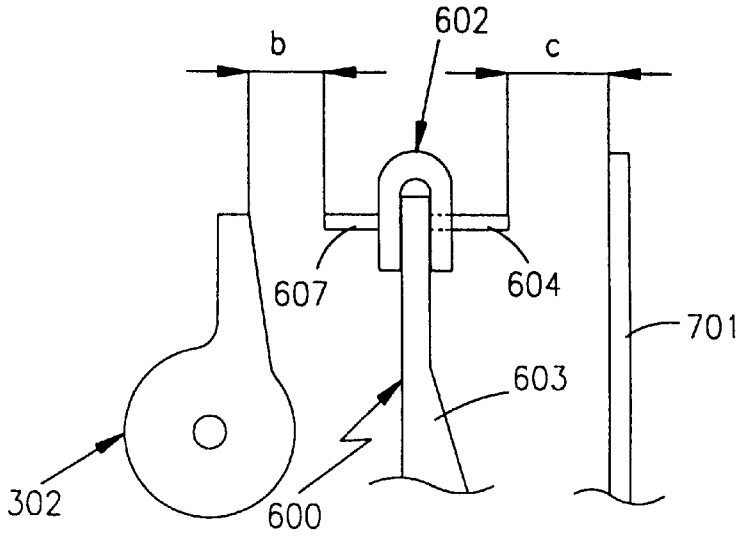
FIG. 19 is a schematic view illustrating the installed states of a bimetal, thermal bar, trip crossbar.

The rated current adjusting operation of the separable circuit breaker according to a second embodiment of the present invention will now be explained with reference to FIG. 19.

In order to adjust the rated current, the gap "b" between the trip crossbar 302 and the thermal bar 600 or the gap "c" between the thermal bar 600 and the bimetal should be adjusted.

At this time, since the gap "c" is fixed, it is possible to control the rated current by adjusting the gap "b".

Namely, if the gap "b" is small, the thermal bar 600 and the trip crossbar 302 contact more easily by a small curving of the thermal bar 600, so that a small rated current is generated. In addition, if the gap "b" is large, the opposite effects occur. Therefore, it is possible to adjust the rated current of the slow trip operation.

In order to adjust the rated current, the thermal cap 602 having the trip protrusions having different lengths is used.

Namely, when using the thermal cap 602 having a lengthy trip protrusion 607, the gap "b" is shortened, so that the rated current is reduced. On the contrary, in order to increase the rated current, the thermal cap 602 having a lengthy trip protrusion 607 is changed with the thermal cap 602 having a small trip protrusion 607, thus increasing the gap "b".

The curved portion of the bimetal 701 based on the thermal cap 602 covered on the central electrode of the thermal bar 600 serves to adjust the rated current by adjusting the gap "b". therefore, the gap "b" is varied by changing the thermal cap 602, so that the rated current is adjusted.

Figure 20:
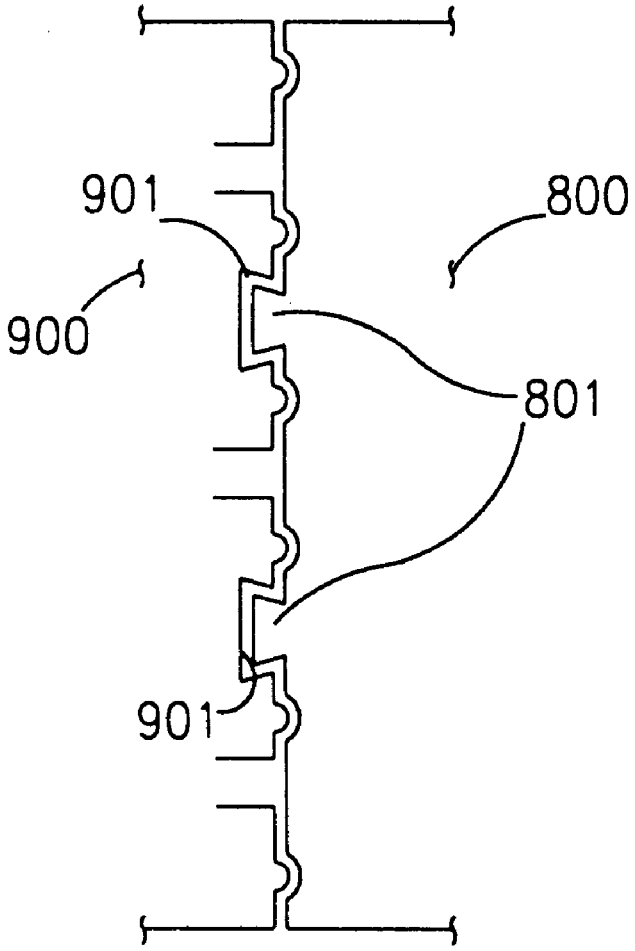
FIG. 20 is a cross-sectional view illustrating an engaged state between a trip apparatus container for a separable circuit breaker and a dovetail of a switching apparatus container according to a third embodiment of the present invention.

The separable circuit breaker according to a third embodiment of the present invention will now be explained with reference to FIG. 20.

In the third embodiment of the present invention, the dovetail engaging guide 801 of the trip apparatus container 800 and the dovetail engaging guide groove 901 of the switching apparatus container 900 are formed in a dovetail shape.

Since the trip apparatus casing 50 and the switching apparatus casing 150 are formed in a dovetail shape in accordance with a third embodiment of the present invention, the weight received by the engaging portion of the connection terminal is distributed to the dovetail engaging guide 801, the dovetail engaging guide groove 901, the engaging guide groove 802, and the assistant guide groove 902, so that it is possible to implement a stability of the system.

In the separable circuit breaker according to a third embodiment of the present invention, the construction and elements except the dovetail engaging guide 801 and the dovetail engaging guide groove 901 are the same as the first embodiment of the present invention. Therefore, the description thereof will be omitted.

As described above, in the separable circuit breaker according to the present invention, it is possible to individually change a part of the elements by separably forming the trip apparatus container and the switching apparatus casing, and it is convenient to easily to adjust the capacity or the rated current. If a part of the elements is damaged, a partial change of the elements is possible, thus reducing the maintenance cost and usability of the system.

Although the preferred embodiment of the present invention have been disclosed for illustrative purposes, those skilled in the art will appreciate that various modifications, additions and substitutions are possible, without departing from the scope and spirit of the invention as recited in the accompanying claims.

What is claimed is:

1. A circuit breaker comprising:

a trip apparatus portion including a trip apparatus container having a trip apparatus therein and a trip portion connection terminal in a lower portion of the trip apparatus container, a trip apparatus cover connected to an upper portion of the trip apparatus container, and an assistant cover rotatably connected to an upper portion of the trip apparatus cover, the trip apparatus including a bimetal element deformable according to heating of a heater when an overcurrent exceeding a rated current flows in a load side and an armature connected to the bimetal element; and a switching apparatus portion including a switching apparatus container having a switching apparatus therein, a switching connection terminal in a lower portion of the switching apparatus container, and a switching apparatus cover connected to an upper portion of the switching apparatus container, the switching apparatus including a crossbar and a handle, wherein the trip apparatus portion and the switching apparatus portion are separable and combinable to form a circuit breaker, when combined the switching connection terminal is connected to the trip portion connection terminal, the crossbar is connected and engaged with the armature according to deformation of the bimetal element of the trip apparatus such that a current flow in power and load sides of the circuit breaker can be opened by the switching apparatus by rotation of the crossbar when an overcurrent exceeding a rated current flows in the load side, and the handle can close the power and load sides of the circuit breaker to reestablish current flow if the switching apparatus opens.

2. The circuit breaker of claim 1, wherein a connection between the switching connection terminal and the trip portion connection terminal is enhanced by providing engaging protrusions formed in one end portion of the switching connection terminal, insertion holes formed in the trip connection terminal, the engaging protrusions of the switching connection terminal being inserted into the insertion holes, and a spring is provided in the insertion holes to surround the engaging protrusions.

3. The circuit breaker of claim 1, wherein an opening is formed in the trip apparatus cover and the switching apparatus cover in order to expose upper portions of the bimetal element installed within the trip apparatus container and the trip crossbar installed within the switching apparatus.

4. The circuit breaker of claim 1, wherein a gap between the armature and the trip crossbar is controlled by providing a protrusion in a predetermined portion of the trip crossbar connected to the armature and connecting a cap with a predetermined thickness and an inner side in a shape corresponding to the protrusion to the protrusion.

* * * * *